United States Patent [19]

Chen

[11] Patent Number: 4,903,176

[45] Date of Patent: Feb. 20, 1990

[54] FLASH BRACELET

[76] Inventor: Jiann-Shyong Chen, No. 25, Sublane 99, Lane 274, Chong-Cheng S. Rd., Yung-Kang Shiang, Tainan Hsien, Taiwan

[21] Appl. No.: 369,614

[22] Filed: Jun. 21, 1989

[51] Int. Cl.[4] ..... F21L 1/00

[52] U.S. Cl. ..... 362/103; 362/104; 362/806; 63/3

[58] Field of Search ..... 362/103, 104, 227, 249, 362/806, 811; 63/3

[56] References Cited

U.S. PATENT DOCUMENTS

| | | | |
|---|---|---|---|
| 2,405,384 | 8/1946 | White | 362/104 |
| 3,790,775 | 2/1974 | Rosenblatt | 362/104 |
| 4,216,464 | 8/1980 | Terry | 362/103 |

*Primary Examiner*—Ira S. Lazarus
*Assistant Examiner*—Sue Hagarman
*Attorney, Agent, or Firm*—Bacon & Thomas

[57] ABSTRACT

A fashionable bracelet having a series of running flash lights which comprises an annular body made of transparent or translucent material and having a channel grooved in an inner sidewall thereof for engaging a bulb belt having a plurality of flash bulbs of different colors connected to outlet legs of an integrated circuit and a power panel having at least a battery connected to an inlet end of the integrated circuit through a contact switch and a snap ring adapted to be engaged in the channel and positioned over the belt for holding the belt in place and actuating ON and OFF operation of the contact switch.

1 Claim, 3 Drawing Sheets

FLASH BRACELET

BACKGROUND OF THE INVENTION

This invention relates to a bracelet and more particularly relates to a bracelet having a series of running flash lights.

A series of fashionable ornaments which are currently used as Disco Ornaments is designed and produced for teen-agers or even adults that facilitates creation of strong feeling or delightful atmosphere in a group activity such as dancing party. Those ornaments include necklace, emblem ring, bangle, coiffure, earring, brooch and so on. It is found that an ornament having sparkling or flash lights can promote said feeling or atmosphere in a dark field such as dancing hall.

SUMMARY OF THE INVENTION

It is accordingly a primary object of this invention to provide a fashionable bracelet having a series of running flash lights for ornamentation, making fun and enhancing delightful atmosphere.

According to the present invention, this and other objects are achieved by providing a flash bracelet which comprises an annular body made of transparent or translucent material and having a channel grooved in the inner sidewall for engaging a belt having a plurality of flash bulbs of different colors connected to outlet legs of an integrated circuit and a power panel having battery connected to an inlet end of the integrated circuit through a contact switch and a snap ring adapted to be engaged in the channel and positioned over the belt for holding the belt in place and actuating ON and OFF operation of the contact switch.

BRIEF DESCRIPTION OF THE DRAWINGS

In order that the present invention may be better understood, a preferred embodiment thereof will be described with reference to the accompanying drawings, in which.

DETAILED DESCRIPTION OF THE PREFERRED EMBODIMENT

Figure 1:
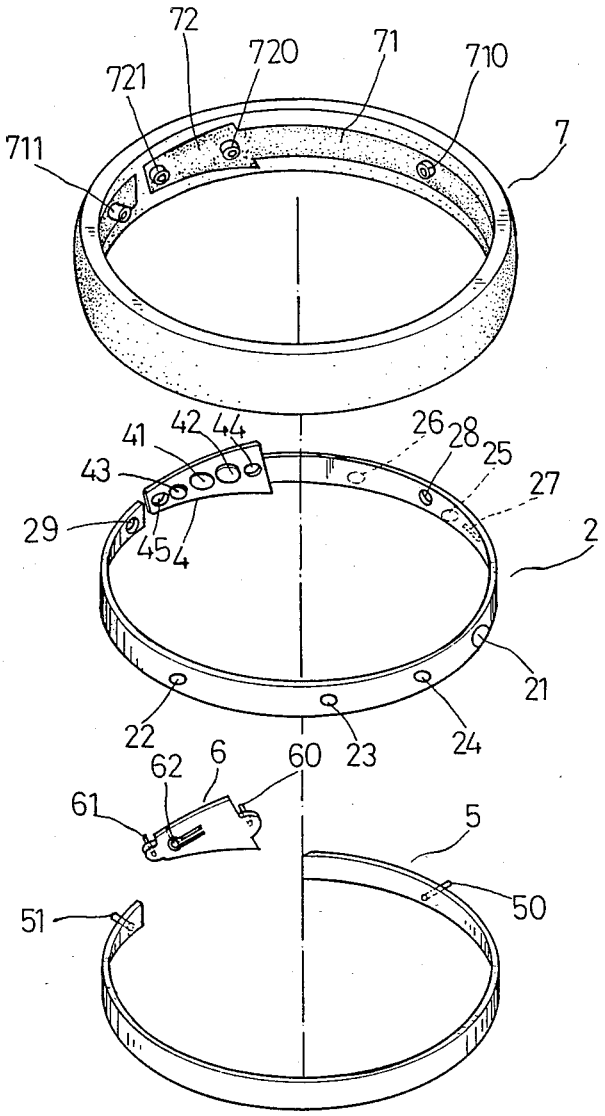
FIG. 1 is a perspective and exploded view of a preferred embodiment of a bracelet according to the present invention.

As shown in FIG. 1, a bracelet comprises an annular body 7 made of transparent or translucent material and having a channel 71 formed in the inner sidewall, extending along the inner circumference of the annular body 7 and with one end terminating with a recess 72 which is slightly spaced from the other end of the channel 71, a bulb belt 2 connected with a power panel 4, which is adapted to be engaged in the recess 72 and adapted to be engaged in the channel 71, a snap ring 5 adapted to be popped into the channel 71 for holding the bulb belt 2 in place in the channel 71 and a switch plate 6 made of conductive material such as metal, functioning as a contact switch and adapted to be positioned over the power panel 4 for holding it in place in the recess 72.

A plurality of hollow cylindrical projections with holes therein extending axially are attached to the inner sidewall of the annular body 7 wherein two projections 710, 711 are located within the channel 71 and another two projections 720, 721 are located within the recess 72.

An integrated circuit (normally and hereinafter named IC) 21, a plurality of flash bulbs 22, 23, 24, 25 and 26 preferably of different colors such as red, green and yellow bulbs and a resistance 27 are evenly fitted in the belt. The connection arrangement among the IC 21, the flash bulbs 22 to 26 and the resistance is explained in detail later. Two holes 28, 29 are provided in the belt 2 and can be respectively slipped onto the cylindrical projections 710, 711 as the belt 2 is fitted in the channel 71. Two batteries 41, 42 functioning as a power source and a contactor 43 which is connected to an inlet end of the IC 21 are fitted in the power panel 4. Two holes 44, 45 are further provided in the panel 4 which can be pressed into the the recess 72 while the holes 44, 45 are slipped onto the cylindrical projections 720, 721.

Two pins 50, 51 extending radially are mounted on the outer periphery of the snap ring 5. Said pins 50, 51 can be respectively plugged into holes of the projections 710, 711 while the snap ring 5 is placed in position in the channel 71 of the annular body 7.

Two pins 60, 61 protrude from two longitudinal ends of the switch plate 6 and are adapted to be respectively plugged into holes of the projections 720, 721 while the switch plate 6 is placed in position in the recess 72 and over the power panel 4 with one side of the switch plate 6 contacting the batteries 41, 42. A switch pin 62 is so assembled in the switch plate 6 as to be reciprocating between an ON position where an end of the switch pin 62 contacts the contactor 43 and an OFF position where the end of the switch pin 62 disconnect the contactor 43.

Figure 2:
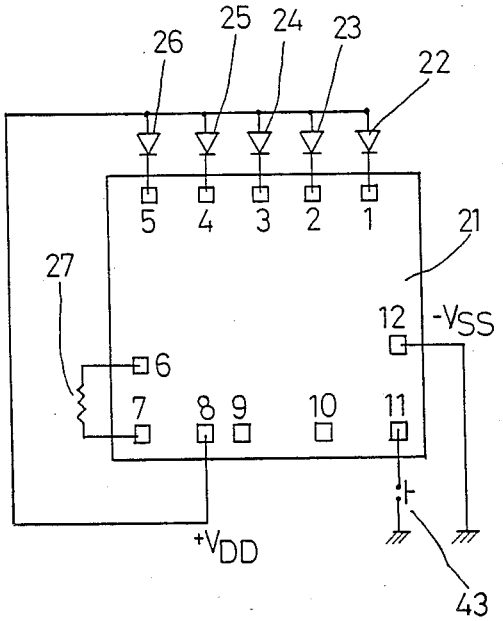
FIG. 2 is a control circuit used in the flash bracelet shown in FIG. 1.
Figure 3:
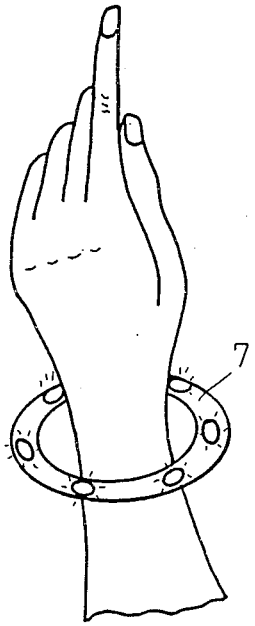
FIG. 3 is a schematic view of the bracelet in assembled condition, and showing the bracelet worn on an wrist.

Referring to FIG. 2, the IC 21 used in this invention is a conventional electronic part such as HT-205 which is available in most of electronic part stores. Said HT-205 of IC has 12 output legs designated from 1 to 12 and flash bulbs 22 to 26 are respectively connected to legs 1 to 5, the resistance 27 is connected between legs 6 and 7 for oscillation, contact switch including the contactor 43 is connected between leg 11 and ground, and leg 12 is grounded. Said circuit is connected in the belt 2.

In operation, the flash bracelet of the present invention can be turned on by pushing the switch pin 62 into ON position wherein an electric power is led to the IC 21 and the flash bulbs 22, 23, 24, 25 and 26 via conductive switch plate 6 and contactor 43 and running flash lights in the bracelet is performed.

While the invention has been described with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims, which scope is to be accorded the broadest interpretation so as to encompass all such modifications and equivalent structure.

What is claimed is:

1. A flash bracelet comprising:

an annular body made of translucent material, having a channel formed in an inner sidewall along an inner circumferece thereof with one end terminating with a recess spaced from the other end of the channel and a plurality of hollow projections with holes therein extending axially, attached to the inner sidewall within the channel and recess;

a bulb belt having openings formed therein and adapted to be engaged in the channel of the annular body by slipping the openings onto the projections within the channel;

an integrated circuit having an inlet end and a series of output legs and concealed in the bulb belt;

a plurality of flash bulbs respectively connected to outlet legs of the integrated circuit and fitted evenly in the belt;

a resistance connected between two outlet legs of the integrated circuit for oscillation and fitted in the belt;

a power panel having openings formed therein and adapted to be engaged in the recess of the annular body by slipping the openings onto the projections within the recess;

a contactor fitted in the power panel and connected to the inlet end of the integrated circuit;

at least a battery fitted in the power panel;

a snap ring adapted to be engaged in the channel and positioned over the belt and having pins extending radially and provided for plugging into holes of the projections within the channel; and a switch plate adapted to be engaged in the recess and positioned over the power panel to contact the battery by plugging two pins protruding outwardly therefrom into holes of the projections within the recess and having a switch pin provided to be operated between on ON position to contact the contactor or an OFF position to disconnect the contactor.

* * * * *